US008393763B2

(12) United States Patent
O'Boyle et al.

(10) Patent No.: US 8,393,763 B2
(45) Date of Patent: Mar. 12, 2013

(54) THERMAL INSULATION DETECTOR

(75) Inventors: Michael O'Boyle, Dartmouth, MA (US); Kevin Oliveira, Fall River, MA (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 417 days.

(21) Appl. No.: 12/703,238

(22) Filed: Feb. 10, 2010

(65) Prior Publication Data

US 2011/0193498 A1 Aug. 11, 2011

(51) Int. Cl.
*F21V 15/00* (2006.01)

(52) U.S. Cl. ..... 362/364; 362/147; 362/373

(58) Field of Classification Search ..... 362/147, 362/276, 364, 373, 802
See application file for complete search history.

(56) References Cited

U.S. PATENT DOCUMENTS

| | | | | | |
|---|---|---|---|---|---|
| 4,293,895 | A | * | 10/1981 | Kristofek | 362/147 |
| 4,388,677 | A | | 6/1983 | Druffel | |
| 4,420,802 | A | | 12/1983 | Smester | |
| 4,754,377 | A | * | 6/1988 | Wenman | 362/148 |
| 4,754,624 | A | | 7/1988 | Fleming | |
| 5,077,650 | A | * | 12/1991 | Cestari | 362/365 |
| 5,174,642 | A | | 12/1992 | Brohard | |
| 5,510,948 | A | | 4/1996 | Tremaine | |
| 5,690,423 | A | * | 11/1997 | Hentz et al. | 362/365 |
| 5,957,574 | A | * | 9/1999 | Hentz et al. | 362/365 |
| 6,505,960 | B2 | * | 1/2003 | Schubert et al. | 362/365 |
| 6,632,006 | B1 | * | 10/2003 | Rippel et al. | 362/366 |
| 7,164,102 | B2 | | 1/2007 | Disalvo | |
| 7,635,953 | B2 | | 12/2009 | Tumula | |
| 7,874,708 | B1 | * | 1/2011 | Jones et al. | 362/365 |
| 7,993,037 | B1 | * | 8/2011 | Buse | 362/365 |
| 8,201,962 | B2 | * | 6/2012 | Wedekind | 362/150 |

* cited by examiner

*Primary Examiner* — Tung X Le

(57) ABSTRACT

A thermal insulation detector for a recessed luminaire fixture comprises a luminaire frame, a junction box connected to the frame, a mechanical switch connected to one of said frame and the junction box, the mechanical switch in electrical communication with an electrical circuit, the electrical circuit including a lamp socket, at least a portion of the circuit passing through the junction box the electrical circuit receiving multiple input voltages, an actuation device extending from the mechanical switch, the actuation device being movable responsive to thermal insulation disposed about the luminaire fixture, the actuation device having a first position and a second position deflectable from the first position, the actuation device being deflectable by the insulation to the second position and actuating a switch which opens the electrical circuit inhibiting operation of the luminaire fixture.

16 Claims, 10 Drawing Sheets

THERMAL INSULATION DETECTOR

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Invention

The present invention relates to a thermal insulation detector. More specifically, the invention relates to a mechanical thermal insulation detector for a non-insulated ceiling (non-IC) recessed lighting fixture.

2. Description of the Related Art

Recessed lights are typically used where low hanging fixtures are not desirable or where focused lighting on a specific area is desirable. They are typically used in personal or commercial properties in living areas, kitchens, work spaces, halls or various types of areas in order to concealed lighting over both large and focused areas. These downlights can sometimes rotate about a vertical axis and/or tilt about a horizontal axis to a desired wall-wash angle in order to illuminate a desired area.

Recessed light fixtures fall into two categories: insulated ceiling (IC) and non-insulated ceiling (non-IC). Insulated ceiling fixtures allow placement of insulation against the metal fixture frame or housing such as in an attic floor. Non-insulated ceiling fixtures require a minimal clearance between the housing and insulation, for fire safety, so as not to trap heat commensurate with National Electric Code.

State of the art temperature sensors are typically input voltage specific. That is, at a specific desirable input voltage, the system will dissipate heat fast enough to operate at an allowable temperature. However, the addition of insulation to a non-IC fixture will not allow dissipation fast enough so that as the temperature increases a thermal sensor will open, inhibiting operation of the fixture.

Contrary to these temperature sensors, current recessed luminaires are being designed to operate at various input voltages. Generally, the temperature sensors designed for a single input voltage will not function properly at voltages other than the specific voltage they are designed for. This causes a problem when used with power supplies and ballasts that self-adjust to accept multiple input voltage levels. As a result, the fixture will either fail to operate or the detection means may not be accurate.

UL requires thermal insulation detection for non-insulated ceiling luminaires. It would be desirable to provide a thermal insulation detector which operates with a wide range of operating voltages and detects the presence of thermal insulation by mechanical force or pressure exerted by the thermal insulation to inhibit operation of the luminaire. Such thermal insulation detector should overcome these and other problems to detect insulation about non-IC fixtures. This insulation detector would accept a wide range of input voltages and overcome problems associated with known thermal detection or thermal overload systems.

SUMMARY OF THE INVENTION

A thermal insulation detector for a recessed luminaire fixture comprises a luminaire frame, a junction box connected to the frame, a mechanical switch connected to one of said frame and the junction box, the mechanical switch in electrical communication with an electrical circuit, the electrical circuit including a lamp socket, at least a portion of the circuit passing through the junction box the electrical circuit receiving multiple input voltages, an actuation device extending from the mechanical switch, the actuation device being movable responsive to thermal insulation disposed about the luminaire fixture, the actuation device having a first position and a second position deflectable from the first position, the actuation device being deflectable by the insulation to the second position and actuating a switch which opens the electrical circuit inhibiting operation of the luminaire fixture. The thermal insulation detector wherein the electrical circuit further comprises a conduit extending from a power supply to the junction box. The thermal insulation detector wherein the thermal insulation being one of rolled mat-type insulation or blown insulation. The thermal insulation detector wherein the actuation device is a diaphragm membrane. The thermal insulation detector wherein the actuation device is a lever. The thermal insulation detector wherein the lever has an expanded surface area for increasing change of engagement with the thermal insulation. The thermal insulation detector wherein the expanded surface area is formed integral with the lever. The thermal insulation detector wherein the expanded surface area is formed separately and connected to the lever. The thermal insulation detector wherein the switch is disposed in the junction box. The thermal insulation detector wherein the switch is disposed outside said junction box. The thermal insulation detector wherein the frame is an enclosure. The thermal insulation detector wherein the mechanical switch is a diaphragm.

A thermal insulation detector for a luminaire fixture comprises a frame for refraining a luminaire in a recessed manner within a ceiling, a junction box positioned adjacent the frame and an electrical circuit having at least one portion through the junction box and in electrical communication with the luminaire, the electrical circuit comprising at least a first wire extending from a power supply to the junction box, a second wire extending from the junction box to the luminaire and a wire connecting the switch to the circuit, a weight activated switch connected to one of the frame or the junction box and in electrical communication with the circuit, a lever extending from the switch for engagement by insulation adjacent the luminaire fixture, the insulation actuating the switch and inhibiting operation of the luminaire. The thermal insulation detector wherein the frame is one of a pan type frame or a frame-arm. The thermal insulation detector wherein the frame retains a housing. The thermal insulation detector further comprising a reflector and the luminaire disposed within the housing.

A thermal insulation detector for a luminaire fixture, comprises a frame having a junction box positioned adjacent a the frame, a luminaire fixture disposed along the frame, an electrical circuit including the luminaire and a switch, at least a portion of the electrical circuit passing through the junction box, a pressure sensitive switch responsive to engagement by insulation disposed about the luminaire fixture, the switch in electrical communication with the electrical circuit, a second end of the lever engaging insulation and actuating the switch when the insulation is detected to inhibit operation of the luminaire. The thermal insulation detector wherein the lever requires a force of about 0.3 ounces to activate the switch. The thermal insulation detector wherein the lever has an area of expanded surface area. The thermal insulation detector wherein the expanded surface area is one of integrally formed with the lever or separately formed and connected to the lever. The thermal insulation detector wherein the pressure sensitive switch is a diaphragm switch. The thermal insulation detector wherein the pressure sensitive switch is a lever.

A thermal insulation detector for a power supply or ballast comprises a pressure sensitive switch responsive to engagement by insulation disposed about the power supply or ballast, the switch in electrical communication with an electrical circuit, the pressure sensitive switch disposed on the power supply or ballast, the electrical circuit also including a luminaire, the switch being actuated when the insulation engages the switch in order to inhibit operation of the power supply or ballast. The thermal insulation detector for a power supply or ballast wherein the power supply or ballast is mounted on the fixture. The thermal insulation detector for a power supply or ballast wherein the thermal insulation detector is mounted remotely from the fixture. The thermal insulation detector for a power supply or ballast wherein the pressure sensitive switch is a lever. The thermal insulation detector for a power supply or ballast wherein the pressure sensitive switch is a diaphragm switch.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
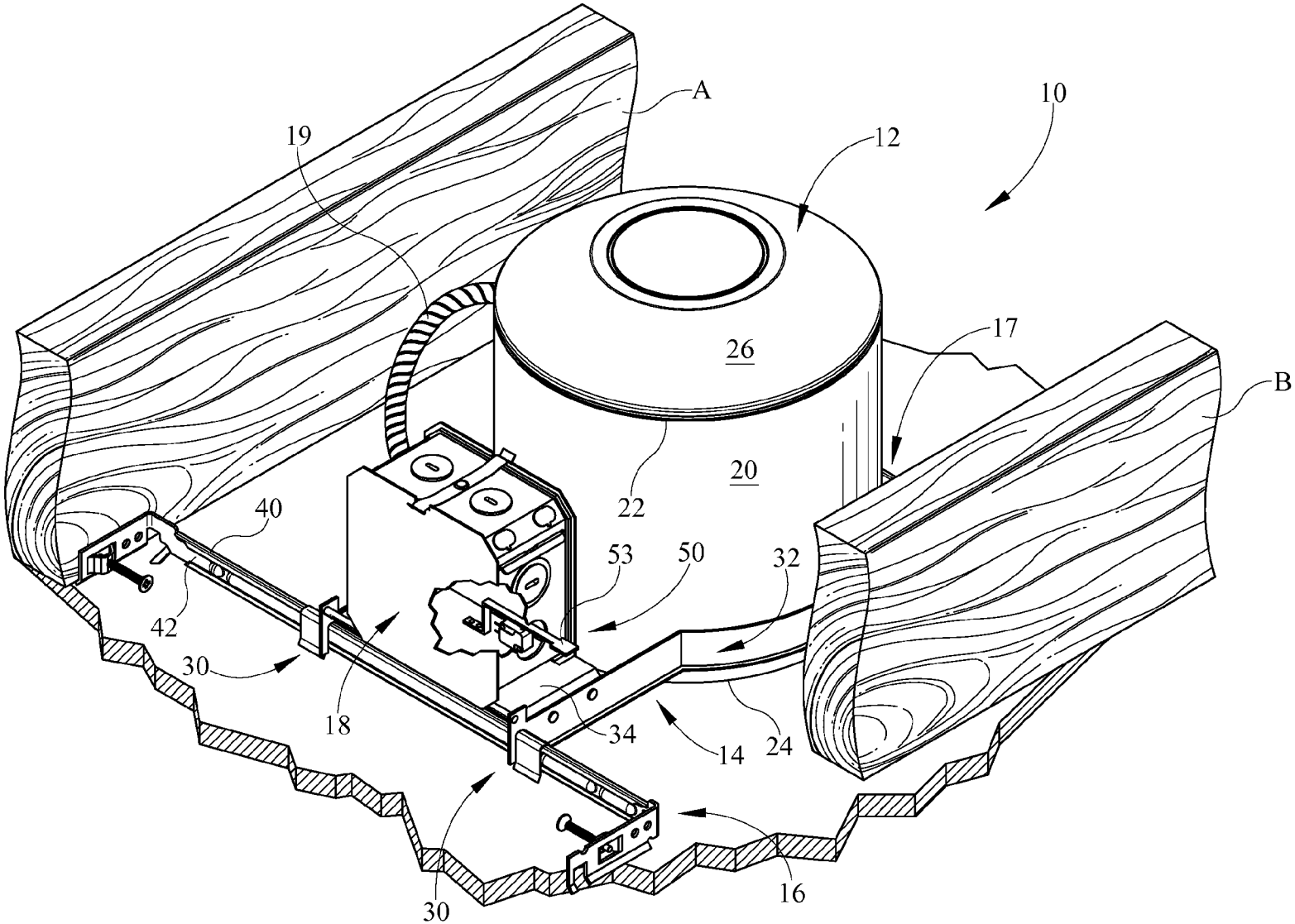
FIG. 1 is a perspective view of an exemplary non-insulated ceiling type fixture positioned between ceiling supports.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Referring now in detail to the drawings, wherein like numerals indicate like elements throughout the several views, there are shown in FIGS. 1-9 various aspects of a thermal insulation detector. The thermal insulation detector operates to mechanically detect thermal insulation disposed about a fixture and inhibit operation of the fixture where appropriate. The thermal insulation detector accepts multiple input voltages and may be positioned at any location on the fixture.

Referring now to FIG. 1, a perspective view of a non-insulated ceiling fixture 10 is depicted. Ceiling supports A, B extend parallel to one another wherein the fixture 10 is disposed therebetween. At least one hanger bar assembly 16 extends between the parallel ceiling supports A, B. More specifically, the instant embodiment utilizes two parallel hanger bar assemblies 16, 17 which extend substantially transverse to the ceiling supports A, B. The fixture 10 includes a can or housing 12, a frame 14 and at least one hanger bar assembly 16. Positioned on the frame 14 is a junction box 18.

According to the instant exemplary embodiment, the can 12 is generally cylindrical in shape having an open lower end and a closed upper end which may be flat or rounded. The can 12 includes a cylindrical outer wall 20 having an upper end 22 and a lower end 24. A cap 26 is positioned at the upper end 22 to close the upper end 22 of the can 12. Although the sidewall 20 is shown as cylindrical in shape, alternative shapes may be utilized and the term "can" should not be considered limited to a cylindrical shape. For example, a square or rectangular shaped housing or sidewalls which define a square or rectangular opening at the lower end 24 may be utilized. The can or housing 12 may be formed of various materials, for example steel or light weight aluminum which is ridged but low weight so as to easily position and handle the fixture 10 during installation. The can or housing 12 provides an opening in the lower end 24 for positioning of a lamp socket, lamp, reflector, and trim structures.

Figure 7:
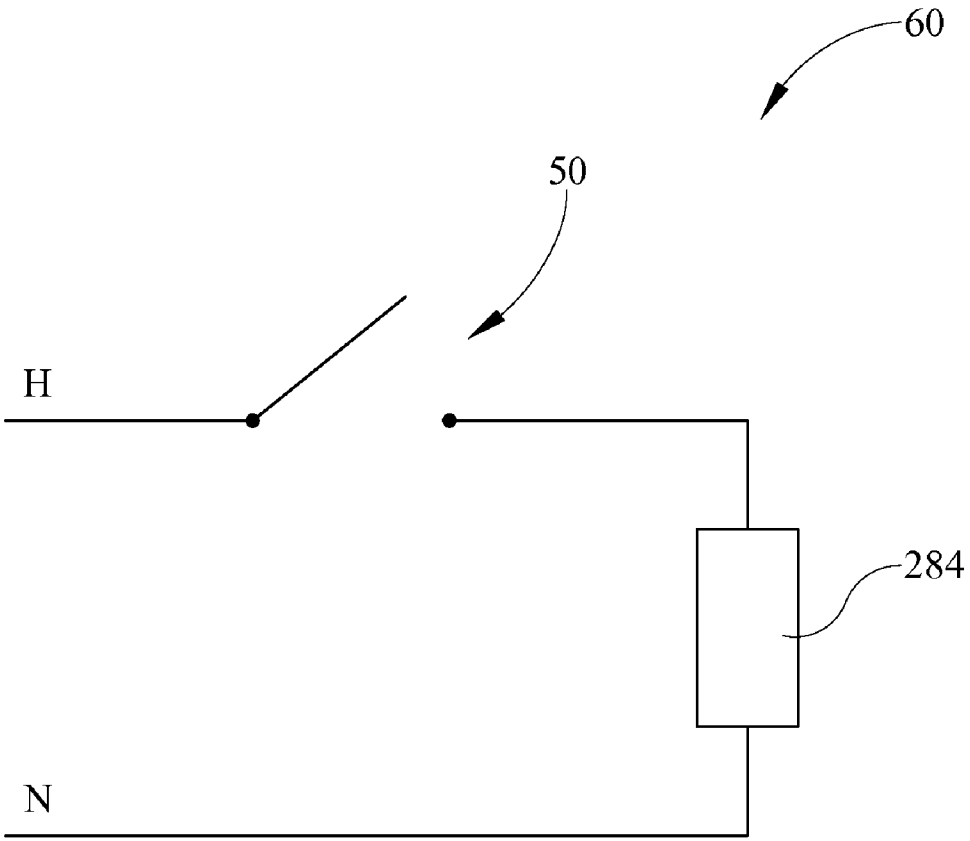
FIG. 7 is a schematic drawing of an alternative circuit utilizing the thermal insulation switch.
Figure 8:
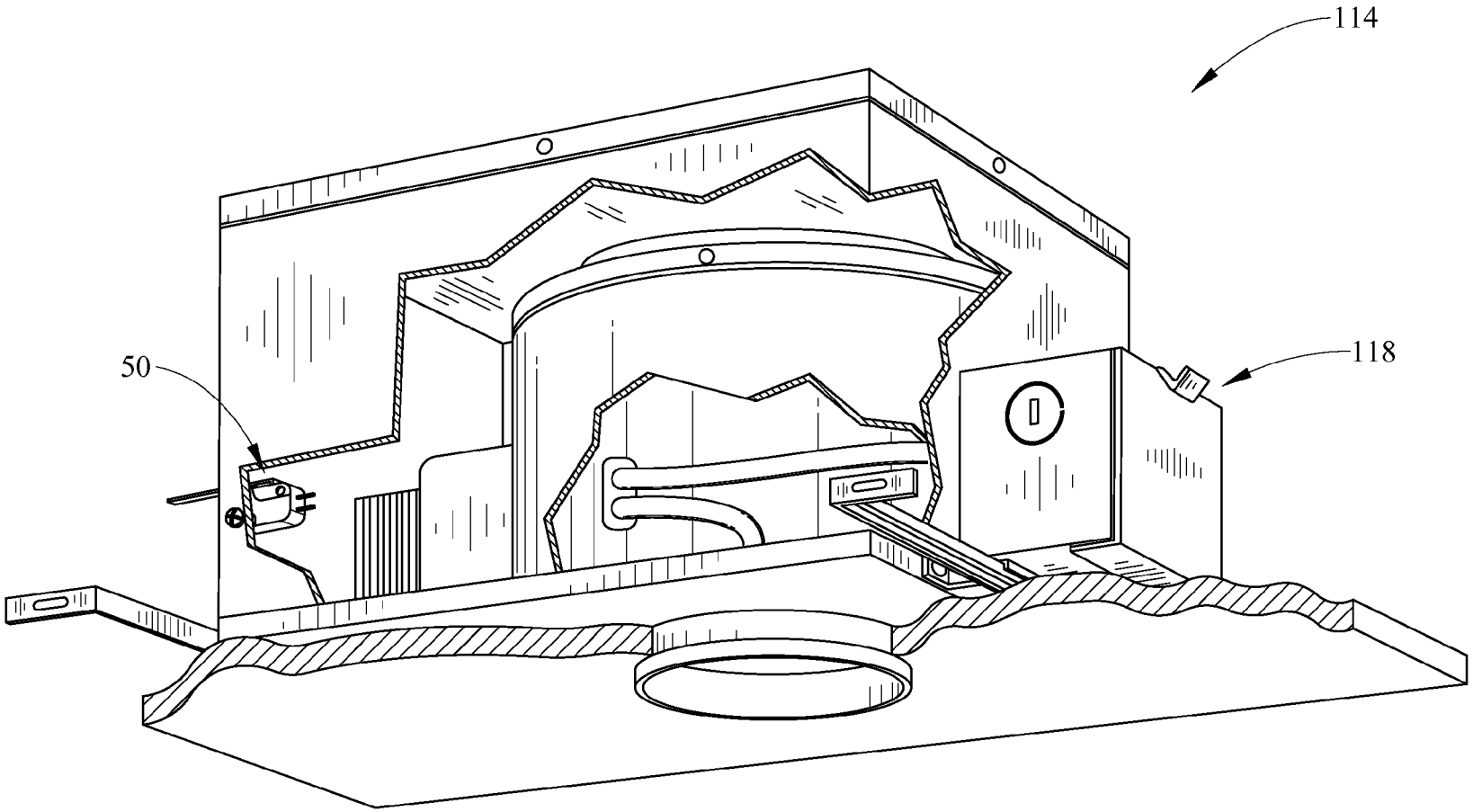
FIG. 8 is an alternative embodiment of a frame which is embodied by an exemplary enclosure.

The can or housing 12 is supported between the ceiling supports A, B and the at least one hanger bar assembly 16 by a frame 14. The frame 14 may be embodied by, but is not limited to, arms, bands, a pan, frame, frame arm structure, an enclosure, such as shown in FIGS. 7 and 8 or alternate structure capable of connecting to at least one hanger bar assembly and a housing 12. According to the exemplary embodiment, the frame 14 includes retaining structures 30 which connect the frame 14 to the at least one hanger bar 16. The frame 14, of the exemplary embodiment, connects to the at least one hanger bar assembly 16 at two positions. The frame 14 includes an opening 32 defined by arms wherein the can or housing 12 is positioned therein. The frame 14 includes a platform 32 upon which the junction box 18 is positioned. The frame 14 may be formed of aluminum or other metal or ridged structure able to support the can or housing 12. It may be desirable to utilize a material for the frame 14 which is similar to the material used in forming the can or housing 12 so as to inhibit known problems with contact between dissimilar metals. A lightweight, rigid material is desirable, such as aluminum. The first and second hanger bar assemblies 16, 17 are defined by a first hanger bar channel 40 and a second hanger bar slide 42 which is slidably positioned in the channel 40. Each of the at least one hanger bar assemblies 16, 17 is connected to the frame 14 and is adjustably positioned between the first and second ceiling supports A, B. Specifically, the slide 42 may move between the first and second ceiling supports A, B so as to be adjustable for various widths of joist or support spacing.

The junction box 18 positioned on a platform 34 receives wiring from a power supply. The wiring from the power supply is connected to the switch wiring which extends from the junction box 18 through conduit 19 to the can or housing 12. The wiring may carry line voltage or low voltage power to a lamp socket positioned within the can or housing 12 for powering a lamp. The fixture 10 includes an insulation detection switch 50 which opens when insulation is placed on fixture. When the switch 50 opens, power to the lamp socket and lamp (not shown) within the can 12 is interrupted until the insulation is removed and the switch 50 returns to the closed position. The insulation detection switch 50 is intended to be used with non-insulated ceiling type fixtures, such as the fixture depicted in FIG. 1, although the specific embodiments and components shown in FIG. 1 should not necessarily be considered limiting as various non-insulated ceiling type fixtures are available and the insulation detection switch 50 may be used with any such fixture.

Figure 2:
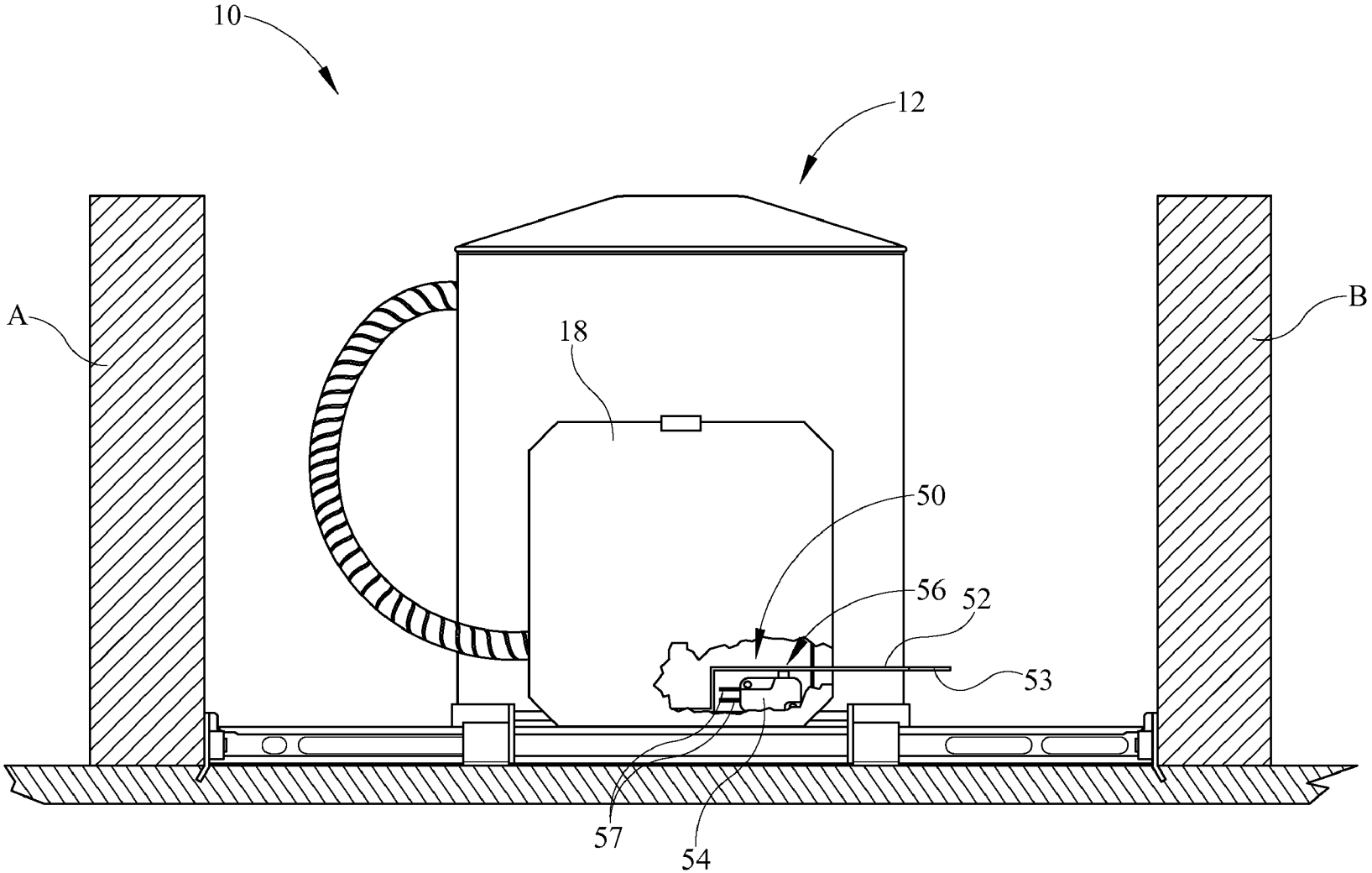
FIG. 2 is a partially sectioned side view of the fixture of FIG. 1 without insulation.

Referring now to FIG. 2, a side view of the exemplary fixture 10 is depicted. The junction box 18 is shown partially cut-away to reveal the insulation detection switch 50 positioned therein. Although the switch 50 is shown positioned in the junction box 18, the switch 50 may be positioned at any location of the fixture 10. For example, the switch 50 may be positioned in the junction box, on an upper surface or sidewall of an enclosure, on the frame 14 on or in the power supply or ballast which may be positioned on the frame 14. Insulation typically has a height of four (4) inches or more so the switch 50 may be positioned at 4 inches or less from the upper surface of the ceiling. This would insure engagement with any insulation which might be placed about the fixture 10. Although the value of four (4) inches is stated, this is merely exemplary and should not be considered limiting. The position of the switch 50 may be dictated by any appropriate local code which dictates amounts of insulation required in a ceiling. The exemplary insulation switch 50 includes a lever 52 extending from the junction box 18 through an aperture. The aperture may be a knockout, or alternatively may be formed specifically for the lever 52 to extend there from. The lever 52 may be connected to the junction box 18 or may be connected to a switch circuit 54. In either event, the lever 52 engages a contact 56 extending from the switch circuit 54. The lever 52 is generally in a horizontal position in a normal, unengaged condition. However, when insulation is placed between the ceiling supports A, B and around the fixture 10, the insulation will engage the lever 52 placing a weight thereon and causing the lever 52 to bend downwardly toward the contact 56 when the lever 52 moves a preselected amount, engagement with the contact 56 opens the switch circuit 54. The switch circuit 54 is normally closed, however when the lever 52 and contact 56 open the switch 54, current cannot flow from the junction box 18 to the socket within the can or housing 12. The switch circuit 54 includes at least one electrical connection 57 for connecting the switch 54 to the electrical circuit of the fixture 10.

Figure 3:
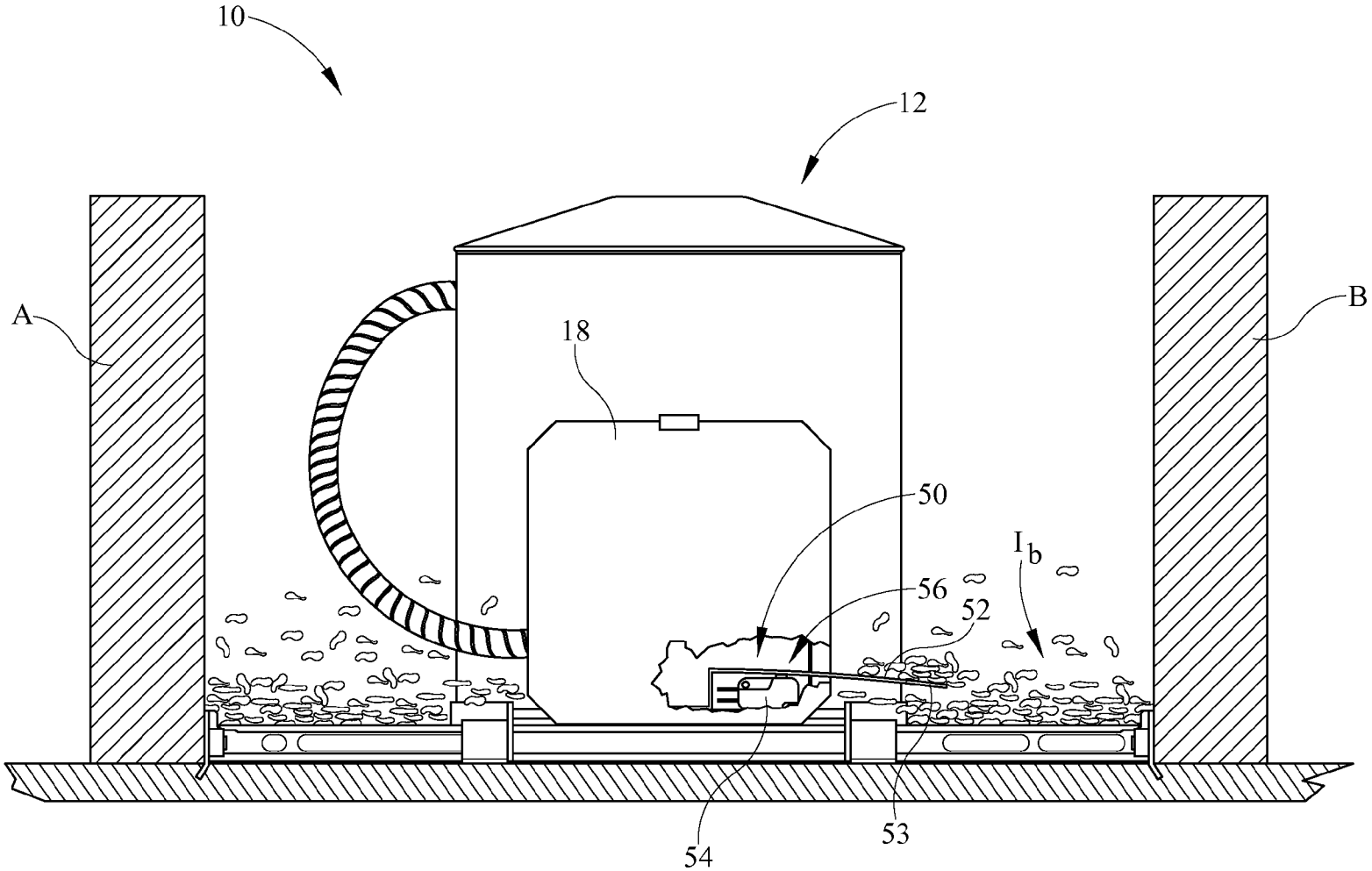
FIG. 3 is a partially sectioned side view of the fixture of FIG. 1 with a first type of insulation surrounding the fixture.

Referring now to FIG. 3, the fixture 10 is shown positioned between the first and second ceiling supports A, B and insulation is blown in around the insulation switch 50. The lever 52 is shown depressed, or bent downwardly due to the weight of the insulation. As seen in FIG. 1, the exemplary embodiment of the lever 52 includes an expanded surface area 53 portion so as to provide sufficient surface area as to allow engagement by blown-in insulation or mat-type insulation. As shown, the upper surface of the lever 52, including the expanded surface area portion 53 (FIG. 1) near the end of the lever opposite the switch circuit 54 are engaged by the blown-in insulation. Despite the light weight of the insulation $I_b$, the weight of the insulation $I_b$ causes movement of the lever 52 which engages the contact 56 and opens the circuit switch 54.

Figure 4:
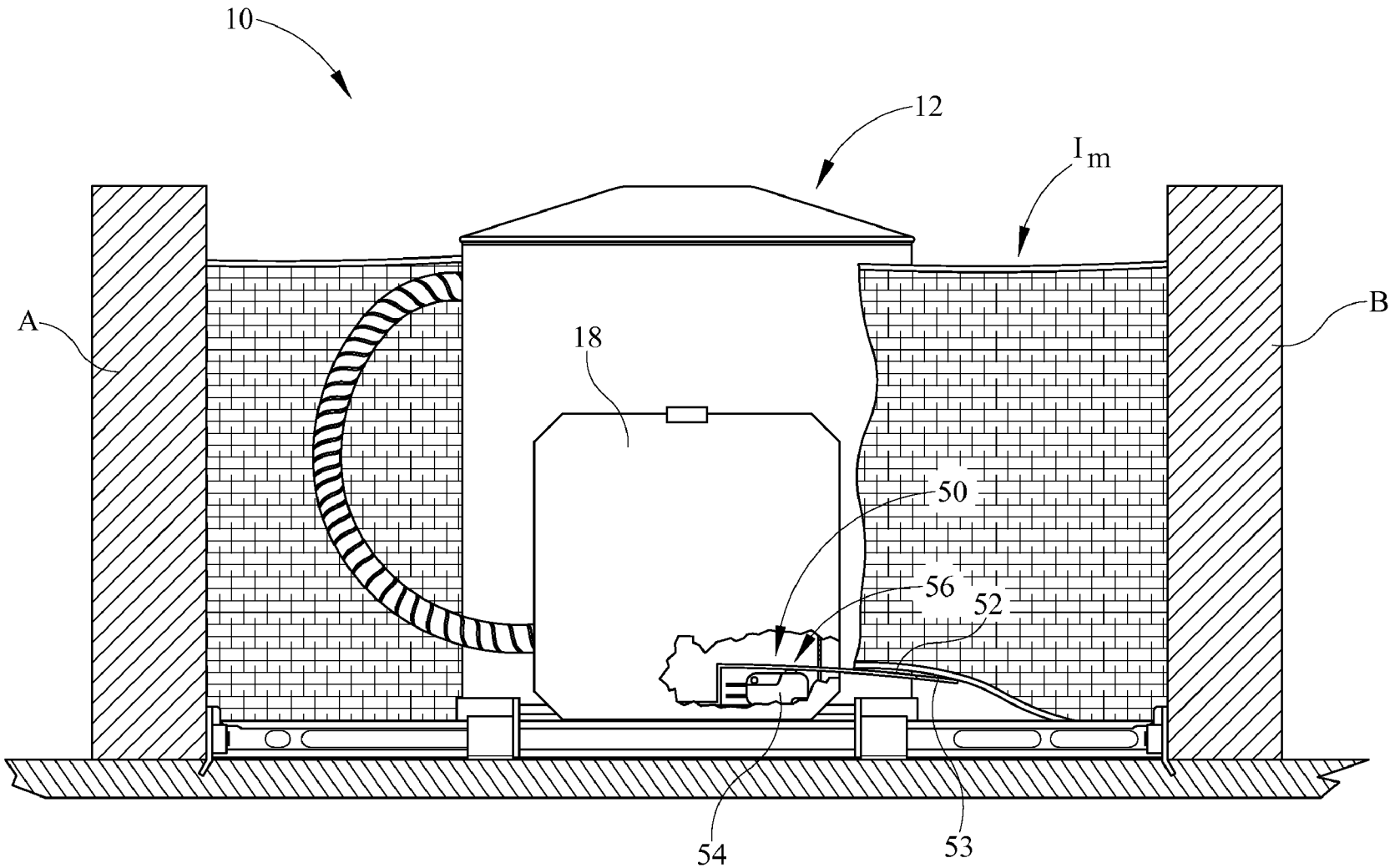
FIG. 4 is a partially sectioned side view of the fixture of FIG. 1 with a second type of insulation surrounding the fixture.

Referring now to FIG. 4, an alternate insulation type is shown being used with a non-insulated ceiling type fixture 10. The side view of FIG. 4 shows the first and second ceiling supports A, B. Around the fixture 10 roll or mat-type insulation $I_m$ is positioned. As with the blown-in insulation, the lever 52 is deflected due to the weight of the insulation $I_m$. The deflection of the lever 52 causes contact 56 to open the switch circuit 54 inhibiting current from flowing from the junction box 18 to a lamp socket within the can 12.

In order to effect proper operation, the lever 52 and switch 54 must be able to differentiate between the absence of insulation and the lightweight or force of insulation material. One exemplary switch which can actuate on this lightweight force is manufactured by Cherry and has a model number D44L-R1ML. The lever 52 has been formed of lightweight flexible metal and has been found to be effective in combination with above switch type in producing a mechanical insulation detection unit. The exemplary lever 52 deflects with about 0.36 ounce of downforce and has a release force of 0.07 ounce. The lever 52 may operate with as little as 0.15 ounce of downforce. Additionally, the exemplary lever 52 and switch 54 receive dual voltages, 125V and 250V for example.

Figure 5:
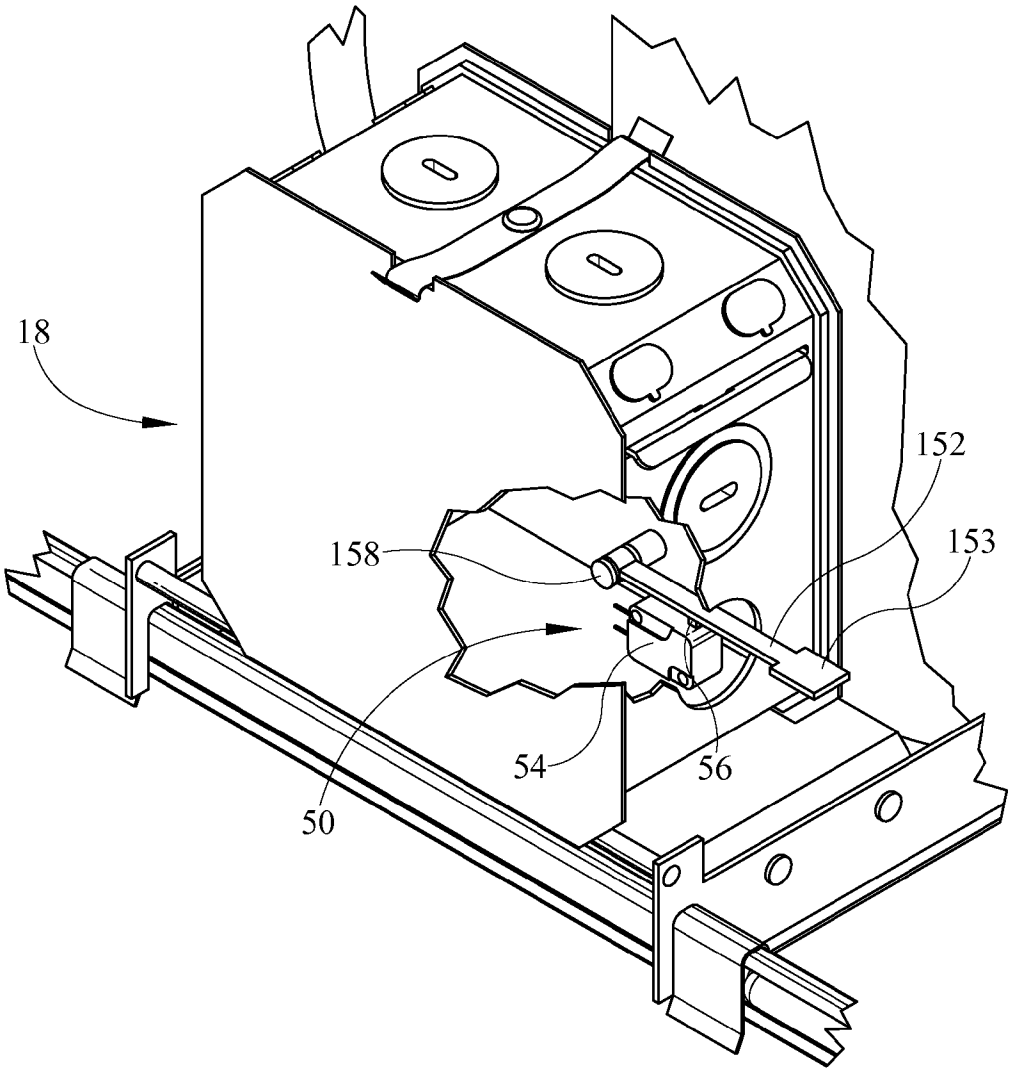
FIG. 5 is a perspective view of one exemplary mechanical thermal insulation switch.

Referring now to FIG. 5, a detailed perspective view of the thermal insulation detector switch 50 is depicted within the junction box 18. The switch is shown having a lever 52 which is pivotally connected to the junction box 18. This is an alternate connection to the lever 52. As shown in FIG. 2 for example, the lever 52 is connected to a bottom surface of the junction box 18 and simply extends over the switch 54 engaging the contact 56 when the lever 52 bends. Referring now to FIG. 5, the alternative lever 152 is pivotally connected to a pin or other structure allowing pivoting motion. The pin 158 extends horizontally from a vertical wall of the junction box 18 so that the lever 152 engages the contact 56 but fails to depress the contact 56 and open the switch 54 in the circuit. The lever 152 also comprises an expanded surface area portion 153 in order to engage insulation and therefore cause the thermal detection switch 50 to open inhibiting operation of the luminaire.

Figure 6:
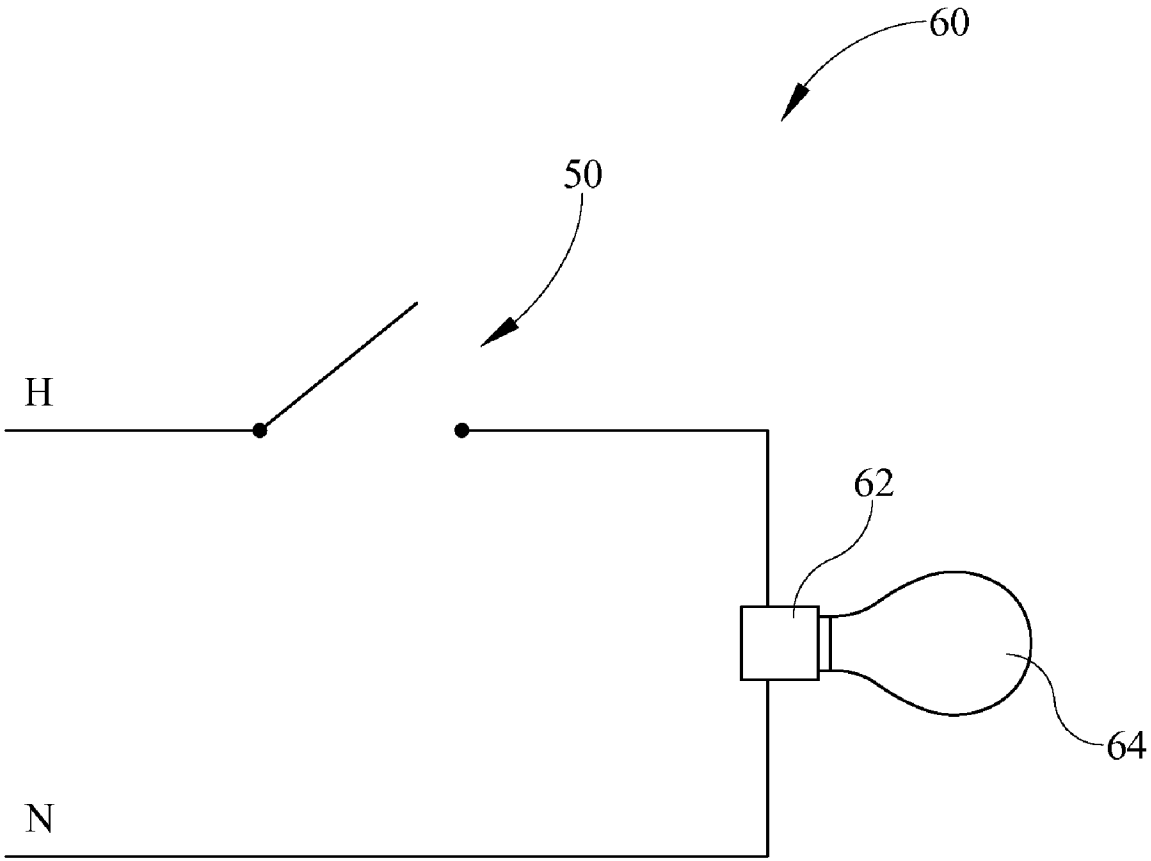
FIG. 6 is a schematic drawing of a circuit utilizing the mechanical thermal insulation switch.

Referring now to FIG. 6, a schematic of a basic circuit 60 is depicted. The circuit 60 includes a hot wire H and the thermal insulation detecting switch 50, a neutral wire N and a socket 62 having a lamp 64 positioned therein. The schematic lamp 64 is exemplary and shows an incandescent lamp, however alternative lamp sources may be utilized and the socket 62 and the lap 64 are merely exemplary. The circuit 60 is shown in an open position meaning the lever 52 is depressed against the contact 56 of the switch 54. When the lever 52 is in its normally upward position, not engaged by thermal insulation, the switch 50 is then closed and the socket 54 is powered and the lamp 64 may be turned on.

As shown in FIG. 7, an alternate schematic view is depicted wherein the insulation detection switch 50 is connected to a power supply 284 which is onboard the fixture 10. While the switch 50 is depicted, it should be understood that the switch 50 may be substituted with the switch 250 shown and described further herein. In this alternative circuit, the power supply is inhibited from powering the fixture and a lamp when insulation is detected.

Figure 9:
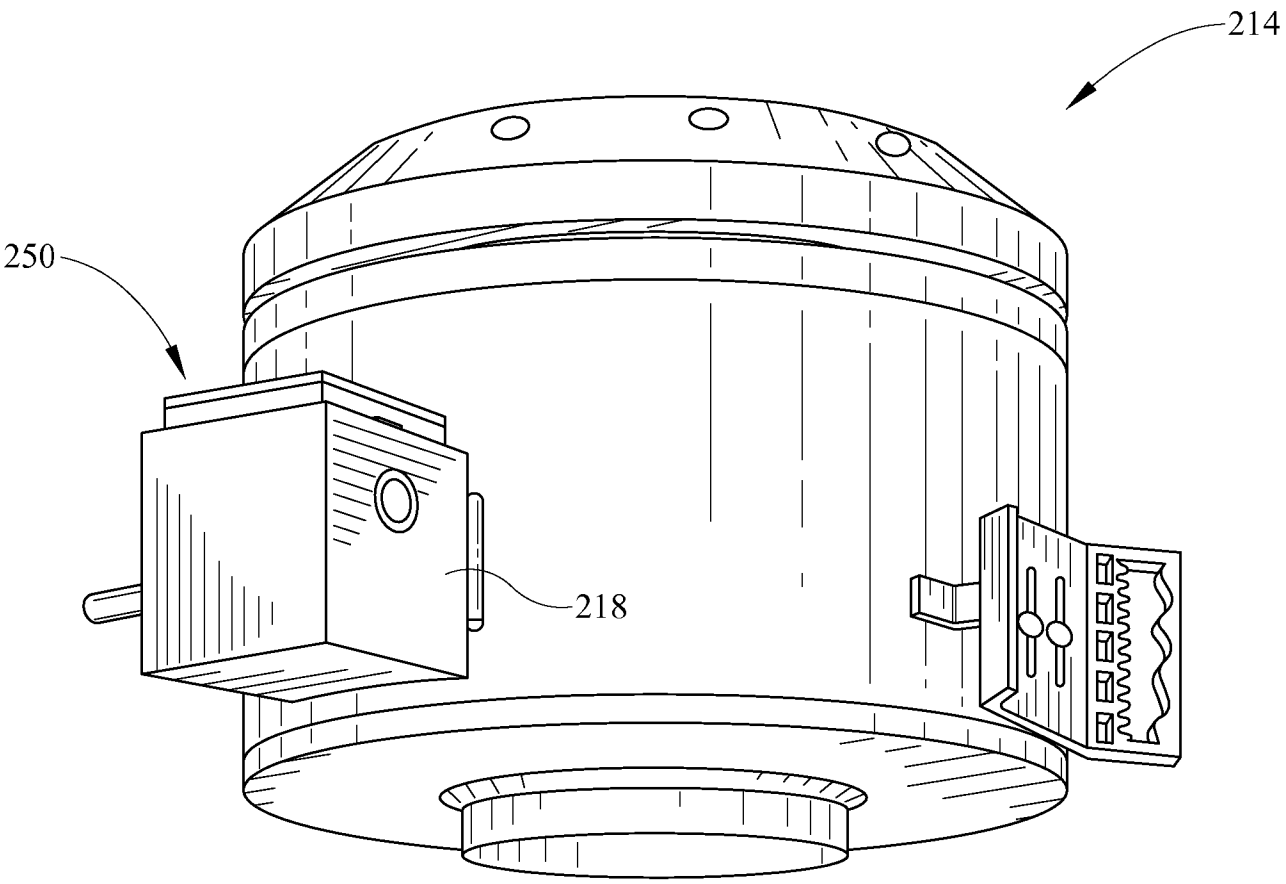
FIG. 9 is a second alternative embodiment of an exemplary enclosure.

Referring now to FIGS. 8 and 9, two alternative frames 114, 214 are shown which are embodied by enclosures. These enclosures differ from frame 14 in that the enclosures 114, 214 envelope the fixture structures rather than the fixture structures being seated on the open frame 14. According to the embodiment shown in FIG. 8, the enclosure defining frame 114 may be defined by a three dimensional rectangular shape. Alternatively, the frame 214 embodiment shown in FIG. 9 is a rounded shape.

Additionally, the switch 50 may be positioned at any location on the frame 114, 214. For example, as shown in FIG. 8, the switch 50 is depicted on an inner sidewall, however the switch 50 may also be positioned on any wall of the enclosure or inside or outside of a junction box 118. The junction box 118 may also include a ballast or power supply therein or such structure may be positioned elsewhere on the frame 114, 214 and the switch 50 may be positioned on such ballast or power supply as well.

As a further example, FIG. 9 depicts the frame 214 having an alternative switch 150 positioned on a structure which may housed a ballast. The switch 150 is facing upward in order to be depressed if insulation is positioned about the enclosure 214. The switch 150 may also be positioned at any location on the frame 214 including the sidewall so long as the insulation can engage the switch 150 when positioned about the enclosure 214.

Figure 10:
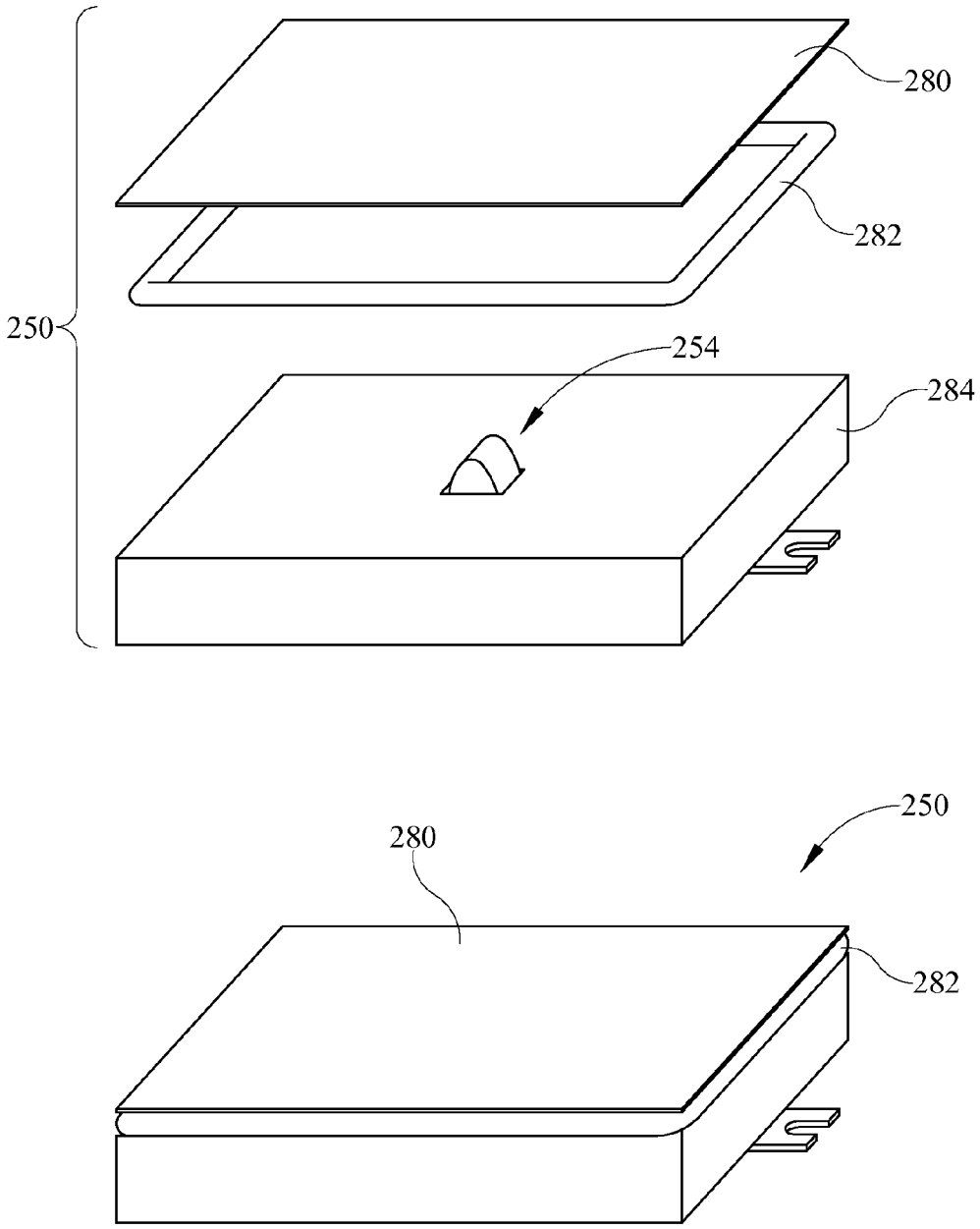
FIG. 10 is a second exemplary switch which may be utilized with a fixture.

Referring to FIG. 10, the alternative switch 250 is depicted wherein a diaphragm assembly may be utilized rather than the lever assemblies previously shown and described. The diaphragm switch 250 receives pressure from the insulation which opens a switch to inhibit operation of the fixture. The diaphragm switch 250 may be located on various surfaces of any of the frames described herein. The insulation which is typically positioned adjacent a light fixture is typically four inches in height or less, although this should not be considered limiting. Accordingly, the diaphragm switch 250, or switch 50, should be positioned at a location which is four inches or less from the upper surface of the ceiling so as to be engageable by any insulation which might be present.

As opposed to the actuation device (lever 52) of switch 50, the actuation device of the exemplary diaphragm switch 250 is a membrane 280, which defines a surface that insulation may engage. The membrane 280 is formed of a lightweight flexible material which may move with force applied by the insulation. The membrane 280 is held in position against a fixture component by a resilient ring 282. The ring 282 is not necessarily round in shape but may be. According to the instant embodiment, the exemplary membrane 280 is generally square shaped and therefore the resilient ring 282 which borders the membrane 280 is also square in shape. Beneath the membrane 280 and ring 282, is a power supply or ballast housing 284. The ring and membrane 282, 280 are mounted to the ballast or power supply 284 according the exemplary embodiment, although such construction is not required. Extending through a surface of the power supply is a switch actuator 254 which is depressed when the insulation depresses membrane 280. The diaphragm assembly 250 may be positioned on various portions of the enclosure, power supply, ballast or junction box of a fixture assembly so long as insulation may engage the diaphragm switch 250. Alternatively, the power supply or ballast may be mounted remotely from the fixture assembly.

The foregoing description of structures and methods has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A thermal insulation detector for a recessed luminaire fixture, comprising:
- a luminaire frame;
- a junction box connected to said frame;
- a mechanical switch connected to one of said frame and said junction box;
- said mechanical switch in electrical communication with an electrical circuit, said electrical circuit including a lamp socket, at least a portion of said circuit passing through said junction box;
- said electrical circuit receiving multiple input voltages;
- an actuation device extending from said mechanical switch, said actuation device being movable responsive to thermal insulation disposed about said luminaire fixture;
- said actuation device having a first position and a second position deflectable from said first position;
- said actuation device being deflectable by said insulation to said second position and actuating a switch which opens said electrical circuit inhibiting operation of said luminaire fixture.

2. The thermal insulation detector of claim 1, said electrical circuit further comprising a conduit extending from a power supply to said junction box.

3. The thermal insulation detector of claim 1, said thermal insulation being one of rolled mat-type insulation or blown insulation.

4. The thermal insulation detector of claim 1, said actuation device being a diaphragm membrane.

5. The thermal insulation detector of claim 1, said actuation device being a lever.

6. The thermal insulation detector of claim 1, said lever having an expanded surface area for increasing change of engagement with said thermal insulation.

7. The thermal insulation detector of claim 6, said expanded surface area being formed integral with said lever.

8. The thermal insulation detector of claim 6, said expanded surface area being formed separately and connected to said lever.

9. The thermal insulation detector of claim 1, said switch disposed in said junction box.

10. The thermal insulation detector of claim 1, said switch disposed outside said junction box.

11. The thermal insulation detector of claim 1, said frame being an enclosure.

12. The thermal insulation detector of claim 1, said mechanical switch being a diaphragm.

13. A thermal insulation detector for a luminaire fixture, comprising:
- a frame for refraining a luminaire in a recessed manner within a ceiling;
- a junction box positioned adjacent said frame and an electrical circuit having at least one portion through said junction box and in electrical communication with said luminaire;

said electrical circuit comprising at least a first wire extending from a power supply to said junction box, a second wire extending from said junction box to said luminaire and a wire connecting said switch to said circuit;

a weight activated switch connected to one of said frame or said junction box and in electrical communication with said circuit;

a lever extending from said switch for engagement by insulation adjacent said luminaire fixture;

said insulation actuating said switch and inhibiting operation of said luminaire.

14. The thermal insulation detector of claim 13, said frame being one of a pan type frame or a frame-arm.

15. The thermal insulation detector of claim 13, said frame retaining a housing.

16. The thermal insulation detector of claim 15 further comprising a reflector and said luminaire disposed within said housing.

* * * * *